United States Patent [19]

Wagenknecht

[11] Patent Number: 4,896,883

[45] Date of Patent: Jan. 30, 1990

[54] DEVICE FOR SETTING A GOLF TEE

[76] Inventor: Alfred E. Wagenknecht, 11971 Brookington, Bridgeton, Mo. 63044

[21] Appl. No.: 284,432

[22] Filed: Dec. 14, 1988

[51] Int. Cl.[4] ..... A63B 57/00

[52] U.S. Cl. ..... 273/32.5

[58] Field of Search ..... 273/32.5, 33, 202–212

[56] References Cited

U.S. PATENT DOCUMENTS

| | | | |
|---|---|---|---|
| 1,846,407 | 2/1932 | Thompson | 273/211 |
| 2,606,764 | 8/1952 | mason | 273/32.5 |
| 2,950,110 | 8/1960 | Slotta et al. | 273/32.5 |
| 3,074,719 | 1/1963 | McKee | 273/32.5 |
| 3,333,848 | 8/1967 | Budzinski | 273/32.5 |
| 3,658,331 | 4/1972 | Driscoll | 273/32.5 |
| 3,670,036 | 6/1972 | Rubino | 273/32.5 |
| 3,671,037 | 6/1972 | Murdock, Jr. | 273/33 |
| 4,142,719 | 3/1979 | Blood | 273/32 B |
| 4,526,369 | 7/1985 | Phelps | 273/32 B |
| 4,660,837 | 4/1987 | Bressie | 273/32.5 |
| 4,714,250 | 12/1987 | Henthorn | 273/32.5 |

FOREIGN PATENT DOCUMENTS

| | | | |
|---|---|---|---|
| 586581 | 11/1959 | Canada | 273/32.5 |

*Primary Examiner*—T. Brown

*Attorney, Agent, or Firm*—Rogers, Howell & Hafferkamp

[57] ABSTRACT

A device for setting a golf tee having a body with a side wall that has a tee-facing surface. A plurality of stepped recesses are vertically aligned and opened through the tee-facing surface. Each step section recess has a downwardly facing wall for contacting the top of a golf tee so that selective positioning of the golf tee within one of the step recess sections will allow the device to set the height of the tee above ground.

7 Claims, 1 Drawing Sheet

FIG. 1.
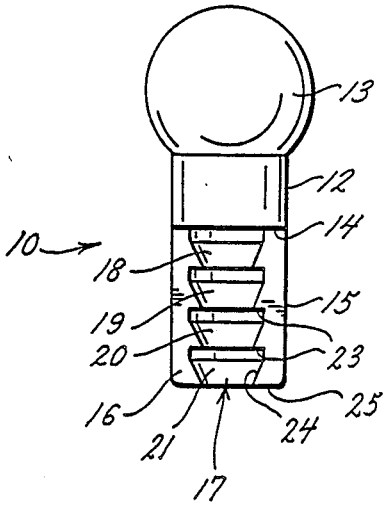
FIG. 2.
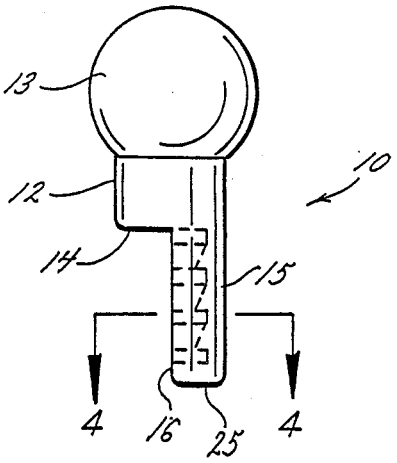
FIG. 3.
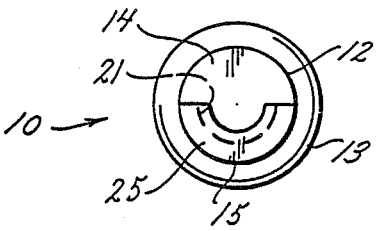
FIG. 4.
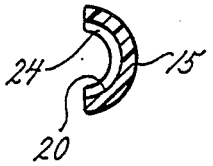
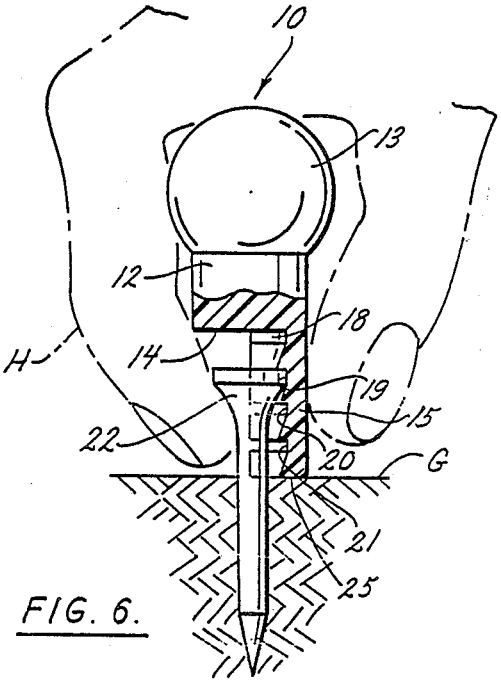
FIG. 6.
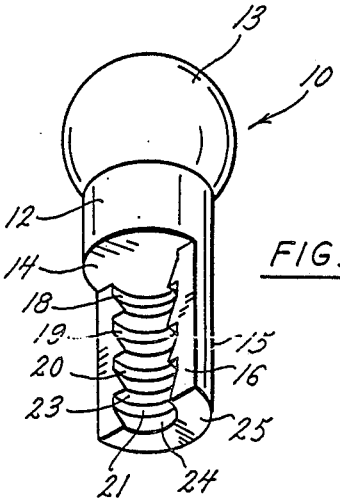
FIG. 5.

DEVICE FOR SETTING A GOLF TEE

BACKGROUND OF THE INVENTION

This invention relates to a golf tee setting device for pressing a golf tee into the ground.

During a round of playing the game of golf, a golfer inserts a tee into the ground a number of times. The purpose of the tee is to support a golf ball at a desired height appropriate for driving the ball with a selected golf club. Generally speaking, the tee should be relatively high if the club is intended to drive the golf ball through a relatively low trajectory, such as by a 1 wood or a driver. As the number of the club increases, the trajectory increases and the tee should be correspondingly pressed further into the ground to support the ball at progressively reduced heights above the ground. Also, the initial shot with some irons, such as a 2 iron, may be hit with a tee and the best height for the tee for one of these irons maybe different from the optimum height for woods.

Most conventionally, a tee is inserted into the ground manually. The golfer estimates by feel what height is attained when the tee is pressed into the ground. Because of this unscientific and inexact procedure, variations in height of the tee above ground are inherent, resulting in unpredictable variations in the character of the drive of a golf ball struck by a golf club. It is still more difficult for the golfer to accurately set the heights of tees corresponding to different golf clubs. All of these uncertainties are further compounded if the golfer is relatively less experienced or as is often the case, does not actually know what should be the optimum tee height for a given club.

Setting a tee at the proper height is also made difficult because the density or hardness of the ground may vary. Sometimes, a mere difference in pressure required to insert a tee into the ground will result in different judgments by the golfer of whether the tee has been set at the proper height. Under extreme conditions, the ground may be so hard that insertion of the tee is almost impossible and sometimes a tee is intentionally broken to facilitate setting it low to the ground.

Because of one or more of the foregoing problems, various devices have been provided for use in setting a tee. These devices are typically inconvenient or cumbersome to use or are expensive or involve several components. For example, U.S. Pat. No. 3,658,331 requires that a coin be fitted into selected slots and then, to use the device, it is necessary to hold the coin in place from opposite sides while also attempting to hold a tee against the coin. U.S. Pat. No. 3,333,848 requires the threading of a disk within a body member. This device requires a screwdriver and typically the setting is rarely adjusted. The devices in U.S. Pat. Nos. 4,660,837, 4,526,369, 3,074,719, 2,950,110, 4,142,719, and 3,671,037 are complex, expensive, and cumbersome to use.

SUMMARY OF THE INVENTION

This golf teeing device comprises a one-piece molded plastic body having a recess in it that is open on one side. The closed side of the recess is formed with vertically spaced shelf sections each complimentary to about half of the upper configuration of a golf tee. The golf tee is readily insertable from the open side of the recess into a selected one of the shelf sections. Each shelf section has a downwardly facing peripheral wall that bears against a top margin of the tee. There is a knob-like configuration at the top of the body that allows the contact area of the body to be distributed comfortably over the palm of a golfer's hand as he presses the device and the tee downwardly, pushing the tee into the ground. When the base of the device contacts the ground, the tee will have been set at the proper height selected according to the golf club to be used.

The golf teeing device of this invention is an improvement over the prior art devices in a number of respects. The present device is of single piece construction and therefore can be formed very inexpensively, such as of molded plastic. Having no moving parts, the device is long-wearing. It is pocket-size so it is readily accessible and is extremely easy to use.

BRIEF DESCRIPTION OF THE DRAWINGS

FIG. 1 is a front elevation view of the golf teeing device.

FIG. 2 is a side elevation view of the golf teeing device as viewed from the right side of FIG. 1.

FIG. 3 is a bottom view of the golf teeing device.

FIG. 4 is a view in section taken along the plane of the line 4—4 of FIG. 2.

FIG. 5 is a perspective view of the golf teeing device.

FIG. 6 is a side elevation view partly in section showing use of the golf teeing device.

DETAILED DESCRIPTION OF THE INVENTION

This golf teeing device 10 has a body 11 that is a single integral unit preferably of molded plastic with a lower cylindrical section 12 and an upper spherical section 13. Somewhat below its upper end, the cylindrical body section 12 has a cutaway portion 14 leaving a semi-cylindrical section 15.

The semi-cylindrical section 15 has a flat side 16. A stepped recess 17 is formed in the semi-cylindrical section 15 and opens to the flat side 16. The recess 17 has a plurality of vertically spaced step sections 18, 19, 20 and 21. Each of the recess step sections 18, 19, 20 and 21 is formed to a shape that compliments substantially half of the upper portion of a standard golf tee 22 of the kind illustrated in FIG. 6. Thus each stepped section 18, 19, 20 and 21 has a generally horizontal downwardly facing annular wall 23 below which there is a sloped or tapered portion 24 complementary in shape to that of an upper side of the tee. (The upper-most horizontal wall section 23 extends into the upper portion of the cutaway portion 14.) The body 11 has a lower flat end 25.

The use of this golf teeing device is convenient and yet accurately establishes the height of a tee. The device 10 is sized to be carried in a golfer's pocket if desired where one or more tees may also be carried. This allows both the teeing device 10 and a tee 22 to be grasped at the same time. The tee is readily inserted into the recess 17 from its open side and is guided toward one of the stepped recess sections 18, 19, 20 or 21. The tee need only be approximately located because as it is pressed into the selected recess section 18, 19, 20 or 21, the sloped side wall 24 of that recess section will guide the top of the tee into contact with the downwardly facing horizontal wall 23.

With the device held with its knob 13 in the palm of the golfer's hand H, as illustrated in FIG. 6, only light pressure with a finger is needed to hold the tee in place within a step recess section, such as the section 19 as also illustrated in FIG. 6. When pressure is applied by the palm of the hand H downwardly against the knob section 13, the annular horizontal wall 23 bearing against an area of the top side of the tee 22 will apply downward pressure to the tee. This makes it easy to push the tee 22 into the ground G until the lower end 25 contacts the ground producing firm resistance. Upon feeling this resistance, the golfer knows the tee has been fully set in the ground at the proper height. The teeing device 13 is easily removed. Simply lifting it will remove it because the inclined section 24 will cam the body 11 away from the tee 22.

The foregoing procedure is repeated for each tee shot that is to require use of a tee 22. The tee 22 is located within the appropriate one of the step sections 18, 19, 20 or 21 depending upon the golf club to be used. If desired, markings on the flat face 16 along side each stepped section 18, 19, 20 and 21 can be produced by the plastic mold to indicate which recess step section 18, 19, 20 or 21 corresponds to which golf club.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. A device for setting a golf tee comprising a unitary body member having a side wall with a tee-facing surface and a permanently open side opposite said surface, a plurality of step recess sections in the tee-facing surface of the side wall vertically spaced from one another, each step recess section having a downwardly facing horizontal wall section for engaging the top of a golf tee, whereby when a golf tee is pressed against said tee-facing surface its upper side will be engaged by a selected one of said downwardly facing wall upon the application of downward pressure on said body, said body having a lower end with the downwardly facing walls being of different distances from said lower end, said step recess sections cooperating with said open side to enable a user to hold a tee inserted into a step section stationary in the device by placing one finger of a hand on the tee and a second finger of said hand on a side of the device opposite the tee and to enable the user to change the position of the tee to a different downwardly facing wall using only said hand.

2. The device of claim 1 wherein each step recess section includes an annular inwardly sloped wall portion below said downwardly facing horizontal wall section.

3. The device of claim 1 wherein said body includes an enlarged knob portion at its upper end for fitting against the palm of a golfer's hand.

4. The device of claim 1 wherein the body is a single element of molded plastic.

5. The device of claim 1 wherein each step recess section has a shape complimentary to a portion of the top of a golf tee.

6. The device of claim 1 wherein the body is generally semi-cylindrical in shape.

7. The device of claim 1 including a generally spherical knob portion at the upper end of the body.

* * * * *